United States Patent [19]

Travis

[11] 4,012,067

[45] Mar. 15, 1977

[54] REFUSE COLLECTION DEVICE

[76] Inventor: Donald P. Travis, 25292 Staysail Drive, Dana Point, Calif. 92629

[22] Filed: Sept. 29, 1975

[21] Appl. No.: 617,518

[52] U.S. Cl. ..... 294/19 R; 294/1 R; 294/55

[51] Int. Cl.[2] ..... A01K 29/00

[58] Field of Search ..... 294/1 R, 19 R, 19 A, 294/51, 55, 57; 15/257.1, 257.4, 257.6, 257.7, 257.8; 56/400.06, 400.11; 248/95, 99, 101

[56] References Cited

UNITED STATES PATENTS

| | | | |
|---|---|---|---|
| 1,659,482 | 2/1928 | Dennemark | 294/19 A |
| 2,658,785 | 11/1953 | Jones | 294/19 A |
| 3,677,596 | 7/1972 | Yonaites et al. | 294/19 R |
| 3,688,483 | 9/1972 | Hamilton | 294/55 X |
| 3,716,263 | 2/1973 | Gatti | 294/19 R |
| 3,733,099 | 5/1973 | Szita | 294/55 |
| 3,754,785 | 8/1973 | Anderson | 294/19 R |
| 3,786,780 | 1/1974 | Pezzino | 294/1 R X |

*Primary Examiner*—Johnny D. Cherry
*Attorney, Agent, or Firm*—Gordon L. Peterson

[57] ABSTRACT

A refuse collection device comprising an elongated handle and a bag supporting member attached to the handle. An open ended bag can be inserted through at least a portion of the bag supporting member with a peripheral region of the bag around the opening being folded over the bag supporting member. A clamp on the handle clamps a region of the bag to thereby retain the bag on the refuse collection device.

6 Claims, 7 Drawing Figures

REFUSE COLLECTION DEVICE

BACKGROUND OF THE INVENTION

This invention relates to a portable, manual refuse collection device of the type which releasably supports an open ended bag. The refuse is collected in the bag and then disposed of by manually releasing the bag from the refuse collection device. Devices of this type are often used for picking up dog droppings and other pieces of litter which would otherwise be difficult to clean up.

One class of prior art of refuse collection devices can only be used with bags which have been specially designed and constructed for use with such devices. The devices shown in U.S. Pat. Nos. 3,052,214, 3,777,708, 3,786,780, and 3,819,220 are illustrative of this kind of device. It is a significant disadvantage that refuse collection devices of this type cannot be used with standard, commercially available plastic bags.

Other prior art refuse collection devices can use standard bags but suffer various other disadvantages, most notable of which is being of relatively expensive and complex construction. This is particularly disadvantageous in a device of this type. For example, U.S. Pat. No. 3,754,785 shows a collection device which requires a spring biased tensioning device in order to retain the bag, and U.S. Pat. No. 3,688,483 shows a device which combines bag attachment means with a garden tool.

SUMMARY OF THE INVENTION

The present invention provides an inexpensive refuse collection device which has a minimum number of parts and which is of relatively simple construction. Standard, commercially available plastic bags can be used with the refuse collection device of this invention.

These features can advantageously be embodied in a refuse collection device which includes an elongated handle, a bag supporting member, and means for attaching the bag supporting member to the handle adjacent one end of the handle. At least a portion of the bag supporting member projects from the handle and at least partially circumscribes a region. This circumscribed region is adapted to receive an open ended flexible bag with a peripheral region of the bag around the opening being folded over the bag supporting member.

One feature of the present invention is the use of manually operable clamping means adjacent one end of the handle for clamping a region of the bag. This permits the bag to be releasably retained on the refuse collection device. The use of clamping means is advantageous because it facilitates attaching the bag to, and removing the bag from, the refuse collection device. In addition, the clamping means is of very simple and inexpensive construction, and does not interfere with other components of the device.

As a further simplification, the clamping means can advantageously include a resilient clamping member and a region of the handle adjacent the clamping member. A region of the bag can then be clamped between the clamping member and the handle thereby causing the handle to serve an additional function, i.e. that of forming a portion of the clamping means.

A further simplification is the manner in which the bag supporting member is attached to the handle. The handle includes a tube and end portions of the bag supporting member are received in one end of the tube. The tube may have at least one inwardly extending projection integral with the tube and lying between the end portions of the bag supporting member to further attach the bag supporting member to the handle.

To facilitate the refuse collection operation and transporting and storing the refuse collection device, the elongated handle is preferably of variable length. This can advantageously be provided by a handle which includes outer and inner telescoping members. To prevent separation of the telescoping members, the outer member includes a tube having at least one inwardly projecting dimple and the inner member includes at least one outwardly extending projection. The dimple and the projection cooperate to prevent separation of the telescoping members. The dimple and the projection are preferably formed integrally with the outer and inner tubes, respectively. This reduces the cost of manufacture and the number of parts required for the device.

The engagement of the dimple and the projection define an extended position of the handle or a maximum length for the handle. By sloping the confronting surfaces of one or both of the dimple and the projection, the dimple and projection provide a wedging action which tends to releasably frictionally retain the handle in the extended position. The collapsed or retracted position of the handle can advantageously be defined by engagement of one end of the outer tube with the fastener for the resilient clamping member.

The invention can best be understood by reference to the following description taken in connection with the accompanying illustrative drawing.

DESCRIPTION OF THE PREFERRED EMBODIMENT

Figures 1, 2, 3, 4, 5, 6, 7:
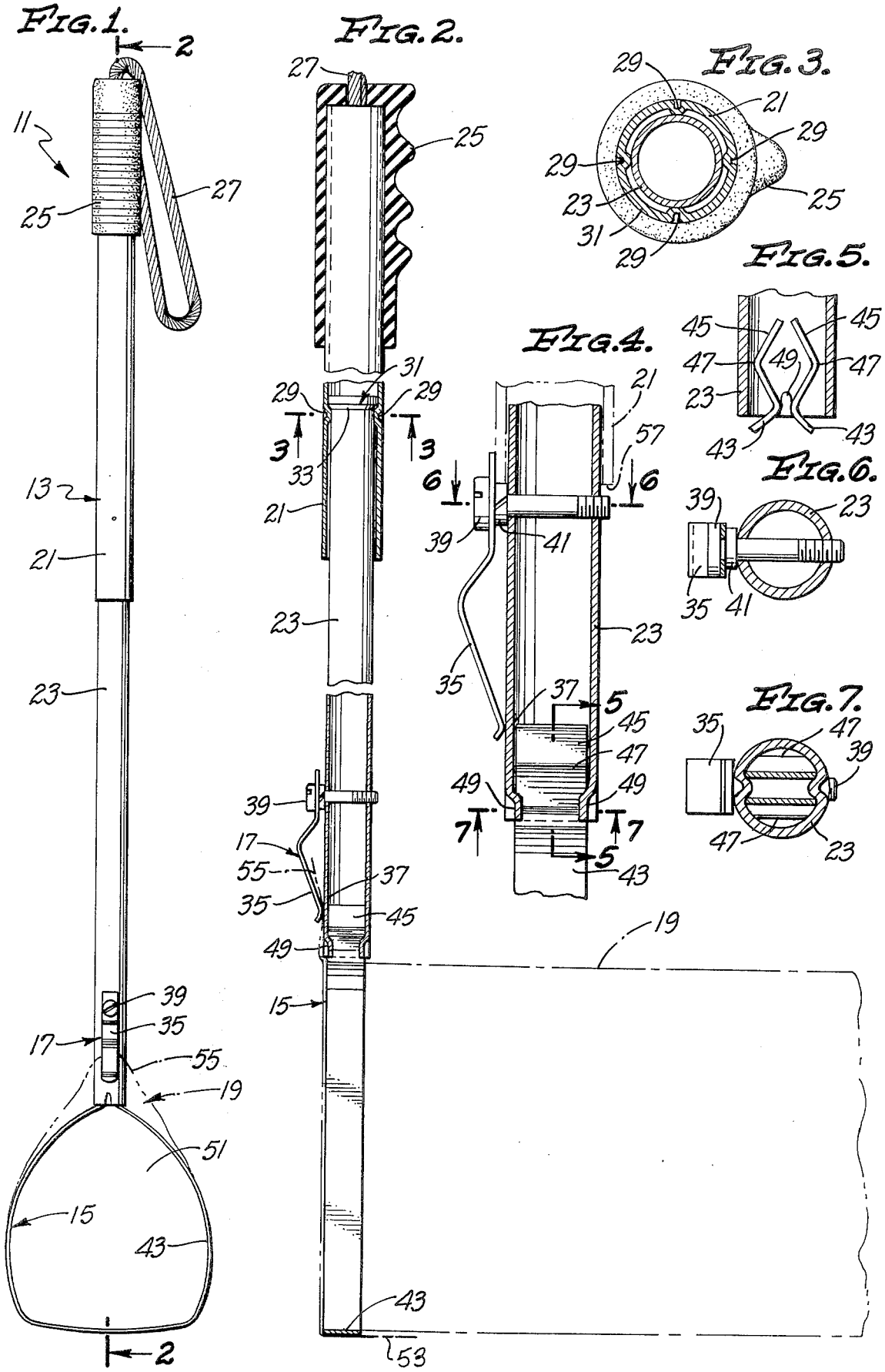
FIG. 1 is a plan view of a refuse collection device constructed in accordance with the teachings of this invention.
FIG. 2 is an enlarged sectional view taken generally along line 2—2 of FIG. 1 and showing the handle in the extended position.
FIG. 3 is an enlarged sectional view taken generally along line 3—3 of FIG. 2.
FIG. 4 is an enlarged sectional view of the region of the refuse collection device adjacent the resilient clamping member with the outer tube being shown in phantom lines to illustrate the collapsed position of the handle.
FIG. 5 is a sectional view taken generally along line 5—5 of FIG. 4.
FIG. 6 is a sectional view taken generally along line 6—6 of FIG. 4.
FIG. 7 is a sectional view taken generally along line 7—7 of FIG. 4.

FIGS. 1 and 2 show a refuse collection device 11, which generally includes an elongated handle 13, a bag supporting member 15, and manually operable clamping means 17. The device 11 is adapted for use with a flexible bag 19 of conventional construction.

To facilitate making the handle 13 of variable length, the handle can advantageously include an outer tube 21, and an inner tube 23 arranged to telescope within the outer tube. The handle 13 may also include a handle grip 25 frictionally retained on the outer end of the outer tube 21 and a carrying cord 27 suitably affixed to the handle grip.

The tubes 21 and 23 are preferably constructed of a relatively strong, light weight material such as aluminum or plastic. In the embodiment illustrated, each of the tubes 21 and 23 forms an elongated hollow cylinder; however, the tubes could obviously be of other configurations. The inner tube 23 is slidably received within the outer tube 21 to thereby provide for varying the length of the handle 13.

Although the tubes 21 and 23 could be prevented from separating in various different ways, in the embodiment illustrated this is accomplished by a plurality of radially inwardly projecting dimples 29 on the outer tube 21 and an outwardly extending projection integral with the inner tube 23, such projection being in the form of an annular flange 31 (FIGS. 2 and 3). Although four of the dimples 29 are illustrated in FIG. 3, any number of the dimples may be provided. In the embodiment illustrated, the tubes 21 and 23 are constructed of aluminum, and the dimples 29 are formed by deforming regions of the tube 21 radially inwardly. Similarly, the flange 31 is formed by deforming an annular region of the inner tube 23 radially outwardly. With the handle 13 extended to its maximum length, the flange 31 strikes the dimples 29 to prevent separation of the two tubes. Assembly of the tubes 21 and 23 is accomplished prior to installing the handle grip 25 by inserting the end of the tube 23 adjacent the bag supporting member 15 through the end of the tube 21 to which the handle grip 25 is ultimately affixed. By providing the flange 31 with an inclined wedging surface 33, the engagement of the dimples 29 with the wedging surface will frictionally releasably retain the handle 13 in the extended position.

The clamping means 17 includes a one-piece resilient, spring clamping member or spring clip 35 and a fixed clamping member 37. In the embodiment illustrated, the clamping member 35 is in the form of a leaf spring, one end of which is attached to the inner tube 23 by a fastener in the form of a screw 39, and the other end of which is resiliently biased against the fixed clamping member 37. A washer 41 spaces the attached end of the clamping member 37 from the inner tube 23.

Although the fixed clamping member 37 could be a separate element, in the embodiment illustrated it is formed by a region of the inner tube 23. Thus, a clamp is formed by the addition of only one element, i.e. the clamping member 35.

The bag supporting member 15 includes a hoop portion 43 which completely circumscribes a region and bent end portions 45 (FIGS. 5 and 7) which are received within one end of the tube 23. Each of the bent end portions 45 has an apex 47 integrally joining a pair of legs which extend in different directions. Opposed radially inwardly extending projections or dimples 49 (FIGS. 4 and 7) retain the bag supporting member 15 against lateral movement and withdrawal relative to the inner tube 23. As best seen in FIGS. 4 and 7, the dimples 49 can advantageously be formed integrally with the inner tube 23 at one end thereof by deforming opposed regions of that tube radially inwardly between the end portions 45.

In the embodiment illustrated, the hoop portion 43 is in the form of a band. The hoop portion 43 should be sufficiently rigid to support and hold open the bag 19. Although the hoop portion 43 completely circumscribes a region, this is not essential. The bag 19 may be of known conventional construction. For example, the bag 19 may be a commercially available flexible plastic bag having an opening 51 at one end thereof.

To use the refuse collection device 11, the user inserts the open end of the bag 19 upwardly through the hoop portion 43 and then folds a peripheral region 53 of the bag 19 around the opening 51 over the hoop portion 43. A portion 55 of the periphery of the bag 19 is clamped between the clamping members 35 and 37. This retains the bag 19 on the bag supporting member 15 with the mouth of the bag held open.

With the bag 19 mounted in this fashion, the refuse collection device 11 can be used to scoop up dog litter or other forms of litter, with the litter being carried by the bag 19. The peripheral region 53 of the bag 19 is folded over the hoop portion 43 to keep the hoop portion clean and to hold the mouth of the bag open. Upon completion of the refuse collection operation, the user pulls the portion 55 of the bag 19 out from between the clamping members 35 and 37, and the weight of the refuse within the bag 19 causes it to drop into a garbage can (not shown) or other suitable receptacle.

The handle 13 will normally be in the extended position (FIGS. 1 and 2) during the refuse collection operation to facilitate refuse collection without stooping or bending over. The handle 13 is preferably moved to a shortened or collapsed position for transport and storage. In the collapsed position, the end 57 of the tube 21 engages the washer 41 as shown in FIG. 4.

Although an exemplary embodiment of this invention has been shown and described, many changes, modifications and substitutions may be made by one skilled in the art without necessarily departing from the spirit and scope of this invention.

I claim:

1. A refuse collection device comprising:

an elongated handle;

a bag supporting member;

means for attaching the bag supporting member to the handle adjacent one end of the handle;

at least a portion of the bag supporting member projecting from the handle and at least partially circumscribing a region, said region being adapted to receive an open ended bag with a peripheral region of the bag around the opening thereof being folded over said portion of the bag supporting member;

manually operable clamping means adjacent said one end of said handle for clamping a region of the bag whereby the bag can be retained on the refuse collection device;

said handle including a tube having an end portion which includes said one end of said handle; said bag supporting member having end portions which are received within said end portion of said tube and means for retaining said end portions of said bag supporting member within said tube; and said clamping means including a clamping member, said refuse collection device including a fastener attaching said clamping member to said handle and projecting into said tube adjacent the end portions of the bag supporting member.

2. A refuse collection device as defined in claim 1 wherein said handle includes outer and inner telescoping members, said outer member includes a tube having at least one inwardly projecting dimple formed integrally with said tube, said inner member includes an outwardly extending projection integral with the inner member, and said dimple and said projection cooperating to prevent separation of said telescoping members.

3. A refuse collection device as defined in claim 1 wherein said retaining means includes at least one inwardly extending projection integral with said tube and lying between said end portions of said bag supporting member.

4. A refuse collection device as defined in claim 1 wherein said retaining means includes at least one inwardly extending projection integral with said tube and lying between said end portions of said bag supporting member, said clamping means includes a region of said tube adjacent said clamping member, said clamping member being resilient and adapted to resiliently clamp said region of the bag against said region of the tube.

5. A refuse collection device as defined in claim 1 wherein said tube is a first tube and said handle includes a second tube, said tubes being telescopically interrelated to permit varying the length of said handle, one of said tubes having an integral inwardly extending projection and the other of said tubes having an integral outwardly extending projection, said projections cooperating to prevent separation of said tubes.

6. A refuse collection device as defined in claim 1 wherein said clamping means includes a region of said tube adjacent said clamping member, said clamping member being resilient and adapted to resiliently clamp said region of the bag against said region of the tube.

* * * * *